US005617755A

United States Patent [19]

Cheers et al.

[11] Patent Number: 5,617,755

[45] Date of Patent: Apr. 8, 1997

[54] PRESSES FOR DRAWING A HOLLOW ARTICLE

[75] Inventors: Christopher F. Cheers; Brian Hill, both of Swindon; Paul Porucznik, Kennington; Ian Flude, East Hanney, all of United Kingdom

[73] Assignee: Carnaudmetalbox (Holdings) USA, Inc., Wilmington, Del.

[21] Appl. No.: 514,099

[22] Filed: Aug. 11, 1995

[30] Foreign Application Priority Data

Aug. 27, 1994 [GB] United Kingdom ..... 9417337

[51] Int. Cl.[6] ..... B21D 22/00; B21D 22/21

[52] U.S. Cl. ..... 72/349; 72/361

[58] Field of Search ..... 72/347, 348, 349, 72/361

[56] References Cited

U.S. PATENT DOCUMENTS 3,735,629 5/1973 Paramonoff .
4,538,441 9/1985 Nishikawa ..... 72/349
4,852,377 8/1989 Mikas et al. .
4,934,167 6/1990 Grims et al. ..... 72/347
5,249,448 10/1993 Fedor et al. ..... 72/349

FOREIGN PATENT DOCUMENTS 0536812 6/1988 European Pat. Off. .

OTHER PUBLICATIONS

European Standard Search Report.

*Primary Examiner*—Lowell A. Larson
*Assistant Examiner*—Rodney Butler
*Attorney, Agent, or Firm*—Diller, Ramik & Wight, PC

[57] ABSTRACT

A press having a frame, a tool support 41 mounted on the frame, a ram 8 movable toward and away from the tool support, and a blank holder 20 surrounding the ram for movement towards and away from the tool support by a crosshead 21 has a crosshead plate 45 guided during motion towards and away from the tool support by pillars 42, 43 operably engaged with the tool support. The blank holder is adjustable to align with the tool support 20 and ram 8.

10 Claims, 6 Drawing Sheets

PRESSES FOR DRAWING A HOLLOW ARTICLE

BACKGROUND OF THE INVENTION

This invention relates to double action presses used to draw hollow articles from a blank, and more particularly but not exclusively to long stroke double action mechanically driven presses used to redraw and wall iron a cup shaped blank, to make a can body.

U.S. Pat. No. 3,696,657 (MAYTAG) describes a press having a first action to drive a ram and second action rod for driving a blank holder to co-operate with dies to redraw and wall iron a cup to a taller can body. The blank holder is mounted on a redraw carriage which is connected to the second action rod by pivotable joints which may wear to spoil the accuracy of blank holder motion. EP-A-0536812 describes a modified "MAYTAG" press in which the weight of the second action rod is supported to reduce wear on the pivotable joints and the redraw carriage is guided by pillars mounted in the die housing. The axis of each pivotable joint is arranged perpendicular to the driving rod to act in the manner of a universal joint permitting tilt but not lateral deviation of the rod direction from the redraw carriage direction by the pillars.

Other longstroke mechanical presses for the purpose of drawing and wall ironing can bodies are described in U.S. Pat. Nos. 3,270,544 (Maeder), 3,663,072 (Cvacho) 3,735,629 (Paramonof) and 4,173,138 (Main). These mechanical presses have served the can making industry well and improvements have permitted increase of stroking speed from about 100 stokes per minute in 1970 to over 300 strokes per minute in 1990. However, there persists a need to increase press speed and reduce lost time arising from tool changes.

In these prior art presses a long ram is urged to move towards and away from a tool support, fixed to the press frame, by a connecting coupling pivotally connected to one end of a lever which swings on a pivot fixed to the press frame. The lever is driven to swing by a connecting rod attached to a crank shaft to constitute a first action linkage. When provided a second action, such as described in U.S. Pat. No. 3,735,629, comprises a pair of second levers pivoted on the frame and driven to swing by cams on the crank shaft to urge a cross head to move a pair of long connecting rods to move a second cross head towards and away from the tool support.

A tubular blank holder is mounted on this second cross head to cooperate with a punch on the ram to permit redrawing of a shallow drawn cup against a redrawing die in the tool support. After redrawing to reduced overall diameter and increased height of side wall, the redrawn cup is pushed through at least one ironing ring to make a can body having a side wall thinner than its bottom wall. Typically the press stroke is about 20 inches long so that the first action ram is over 40" long. Typically, the connecting rods of the second action are also about 40" long. As press speeds increase the inertia forces arising from the combined weight of second action cross heads and connecting rods also increase so an improved support of the blank holder is required. Furthermore, adjustment of the position of the blank holder in respect to the redrawing die and ironing rings required laborious adjustment of the blank holder using adjusting the second crosshead, whenever the blank holder is changed, to ensure application of a correct blank holding force in alignment with the die and rings. Incorrect alignment of the blank holder with a redrawing die gives rise to an uneven holding pressure around the blank so that the height of the redrawn cup varies around the side wall of the redrawn cup.

SUMMARY OF THE INVENTION

In order to overcome these problems this invention provides a subpress assembly, for use in a press having a first action to drive a ram supporting a punch, and a second action comprising a pair of drive rods joined by a crosshead to drive a blank holder, to co-operate with tools in a tool support said subpress comprising:

a tool support having a first side wall portion, a second side wall portion parallel to the first side wall portion, and a base joining the side wall portions to enclose a tool support surface extending from a first end surface to a second end surface the wall portions; characterised by at least two pillars extending away from a first end surface of the side wall portions in a directional parallel to axis of the tool support surface; and a crosshead plate guided by the pillars for motion towards and away from the tool support, said crosshead plate having a hole through it centered on the axis of the tool support surface to permit passage of the punch to the tool support by said first action and means to connect the crosshead plate to the crosshead driven by the second action.

A hollow blankholder may be fixed in axial alignment with the axis of the tool support surface, on the face of the crosshead plate facing the first end wall surface of the tool support.

In this embodiment the blank holder has a flange centred by a three point array of two blocks, with shims if required, and a retaining screw.

In a preferred embodiment the tool support surface includes a pair of parallel rails fixed to an interior surface of the wall portions of the tool support.

The preferred subpress assembly has a lid, spanning the side walls of the tool support, which supports a third rail to complete a three-point support for tools in the tool support.

Preferably the pillars are rooted in the first end wall of the tool support and the crosshead plate has linear bearings which surround the pillars.

It is desirable that the crosshead plate has couplings which permit lateral displacement relative to the second action of a press.

If desired the subpress assembly has a first side wall of the tool support is higher than the second side wall and the side walls and base define a "U" shaped channel inclined to the base.

In the preferred embodiment the tool support has opposed flanges extending from the side walls to permit alignment and fixing to a press frame. When in use a press the opposed flanges rest on press frame members with a lower portion of the tool support between the frame members and opposed wedges between the lower portion and frame members hold the tool support rigidly in the frame members.

Various embodiments will now be described by way of example and with reference to the accompanying drawings, in which:

DESCRIPTION OF THE PREFERRED EMBODIMENTS

Figure 1:
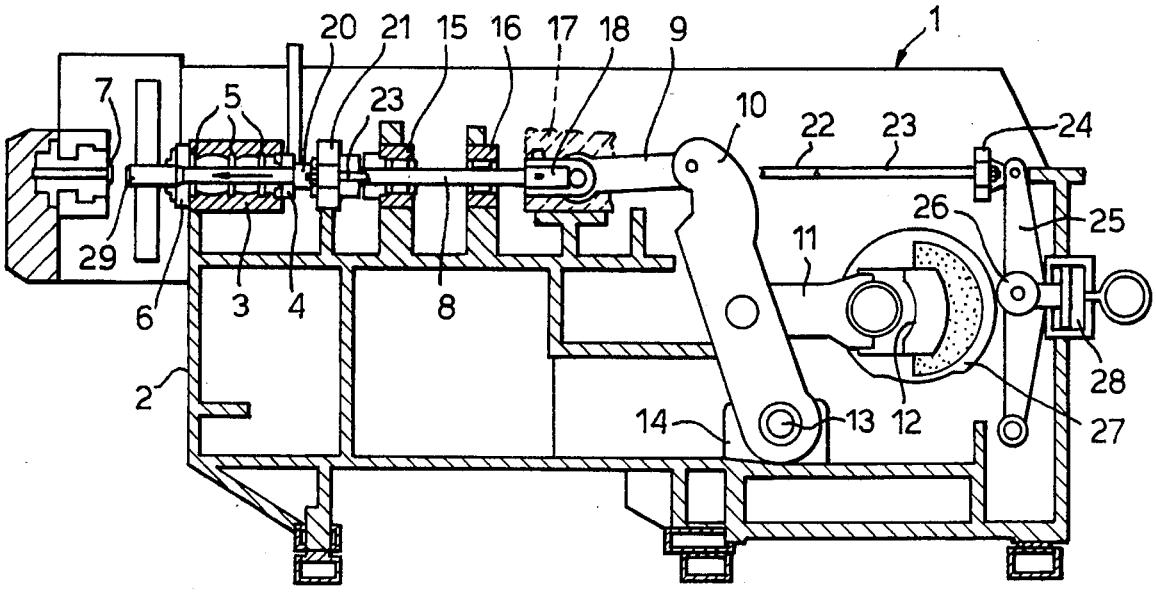
FIG. 1 is a diagramatic side view of a known press having a crosshead ram and tool support.
Figure 2:
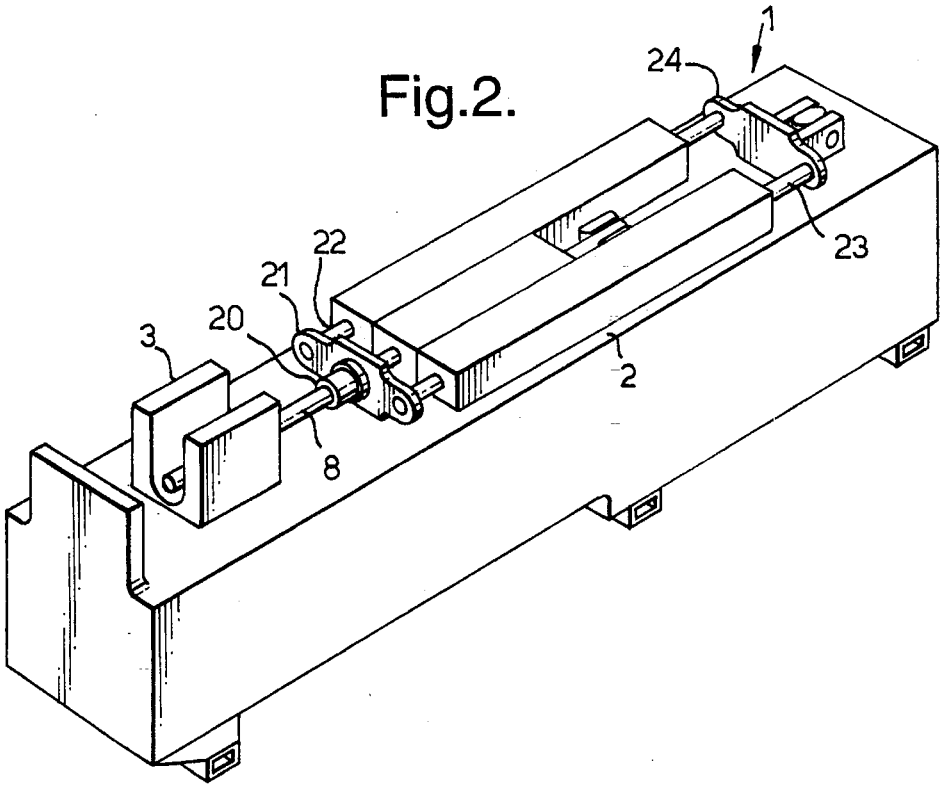
FIG. 2 is a perspective sketch of the press of FIG. 1.

FIGS. 1 and 2 show diagramatically a typical form of long stroke press used to redraw a cup to a reduced overall diameter of side wall which is then passed through at least one ironing ring to reduce the thickness and increase the length of the redrawn side wall of the cup.

In FIG. 1 the press 1 comprises a frame 2 which supports a tool pack 3 comprising a redrawing die 4, three ironing rings 5 and a stripper 6. A bottom forming pad 7 is axially aligned with the tool pack 3.

The press has a first action assembly comprising a long ram/punch 8, a connecting link 9, a lever arm 10 and a connecting rod 11 operably connected to a crank shaft 12 so that rotation of the crank shaft moves the punch 8 in and out of the tool pack 3. The lever arm 10 swings on a pivot 13 mounted in a block 14 on the frame.

The press has a second action assembly comprising a blank holder 20 mounted on a crosshead 21 connected to a pair of long push rods 22, 23 shown cut away in FIG. 1, which extend to a spreader plate 24 which is coupled to a pair of second levers one of which is visible and denoted 25 which engages with a follower 26 engaged with a cam 27 on the crank shaft. An air cylinder 28 urges the follower on the second lever 25 to follow the rotating cam surface as movement of the lever and rods 22, 23 and crosshead 21 moves the blank holder towards the tool pack.

In use, the cam 27 controls the blank holder motion to enter a cup fed from feeder chute 28, and press the cup against the surface of the redraw die 4. The first action assembly then moves the ram punch 8 into the cup to drive the cup through the tool pack until it strikes the bottom forming pad 7. On the return stroke of the punch/ram the drawn and wall ironed can 29 is stripped from the punch by the stripper 6.

A problem arising in this sort of press is that the punch and ram assembly is long and slender, typically over a meter long by about 65 mm diameter. The ram is supported by a pair of hydrostatic bearings 15, 16 and a slide way 17 (shown in dashed lines) which supports a coupling 18 which joins the ram 8 to the connecting link 9. However there persists a problem of vibration of the punch arising from impact with the bottom doming pad and a problem of punch alignment with the tool pack because the punch droops.

The purpose of the blank holder 20 is to firstly enter the cup and centre it with respect to the redrawing die 4, and then apply an even pressure to a peripheral portion of the bottom of the cup to prevent wrinkling of the side wall of the cup as it is drawn to reduced diameter and greater height. Problems arise because:

(a) the long push rods 22, 23 may increase in length in the period between setting the press and reaching running temperature;

(b) if wear develops in the second action linkage skew forces may be applied to the cross head and blank holder;

(c) the setting of clearance between the blank holder and die is laborious because it requires precise adjustment of adjusting screws every time the blank holder is changed.

(d) even if an air cylinder arrangement mounted on the cross head is used to apply the final blank holding pressure this pressure may be spoiled by change in the second action linkage;

(e) adjustment of axial alignment of the blank holder and redraw die is laborious because it requires manual turning of the press to enter the blank holder into the die and then trial and error adjustment. Inaccuracy of setting of the blank holder gives rise to redrawn cups having an uneven height of side wall. This uneven height is made worse by wall ironing.

Figure 3:
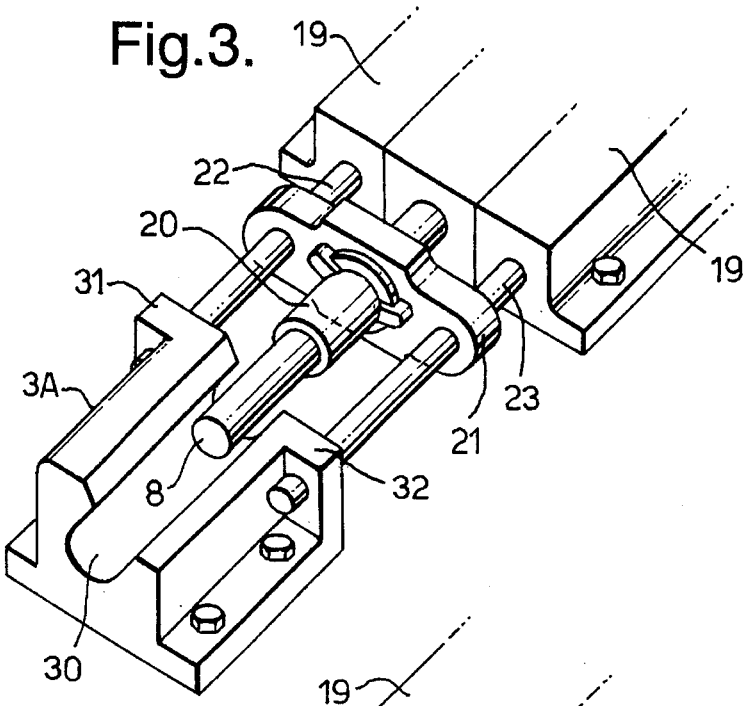
FIG. 3 is a perspective sketch of a press illustrating a problem.

FIG. 3 shows, on a slightly greater scale than FIG. 2, a simple idea for a press comprising the crosshead 21, ram 8 and a modified tool support 3A having an inclined entry to the cradle surface 30 which supports the wall ironing dies (not shown in FIG. 3). The tool support 3A has a pair of lateral flanges 31, 32 each of which defines a bore fitted with a linear bearing to receive one of push rods 22, 23 which not only serve to move the crosshead but also, now extend towards and into linear bearings in each flange 31, 32 to align the crosshead 21 with the tool support 3A and cradle surface.

With alignment of crosshead and tool support improved, the blankholder 20 may be carefully located and fixed on the crosshead by clamps to align with the axis of the cradle surface 30. This simple idea is not preferred because inaccuracy of alignment of the ram and tool support may arise with this simple embodiment because the rods are distant from the blank holder. Furthermore, if there is wear on the crosshead rod bearings 19 to an extent that the crosshead rods deviate from linear motion, deviant forces arising at the cradle bearings 31, 32 will cause premature wear and spoil the beneficial alignment.

Figure 4:
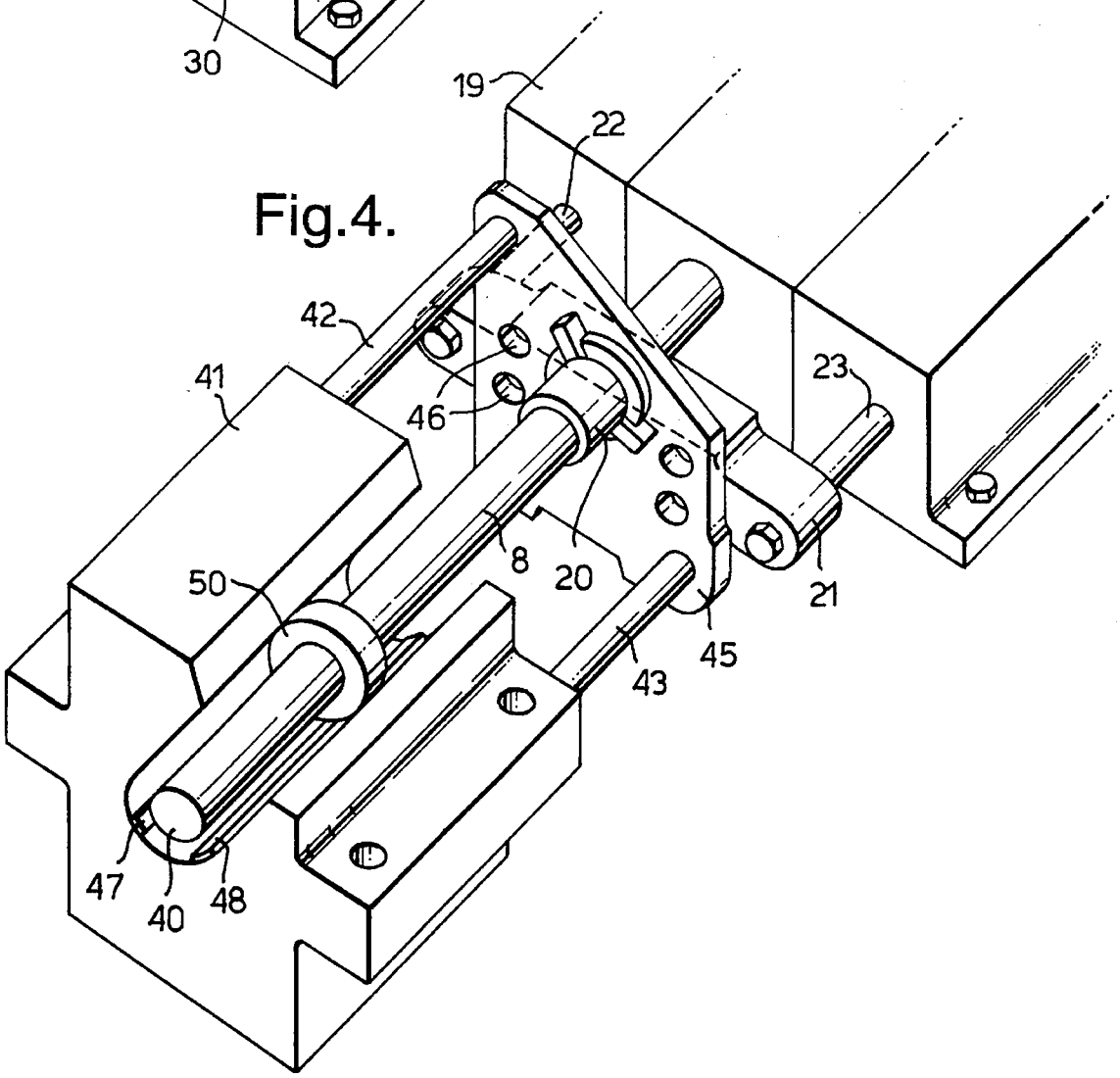
FIG. 4 is a perspective sketch of crosshead ram and tool support according to the invention.

FIG. 4 shows a preferred embodiment of the invention in which the push rods 22, 23 terminate in the crosshead 21 and alignment of the blankholder 20 with a tool support is provided by a subpress assembly comprising a tool support 41 three parallel pillars 42, 43 rooted in the tool support (only two visible in FIG. 4) and a plate 45 having three linear bearings in which the pillars slide. The plate 45 is fixed to the crosshead by four bolts 26 each having a flanged nut which permits lateral motion between the crosshead and plate as will be described later.

The blank holder 20 is aligned with the cradle surface 40 of the tool support which, in a preferred embodiment, comprises a pair of support rails 47, 48 extending the length of the cradle surface to provide a "two-point" support for each ironing ring 50 (only one ring is shown).

Figure 5:
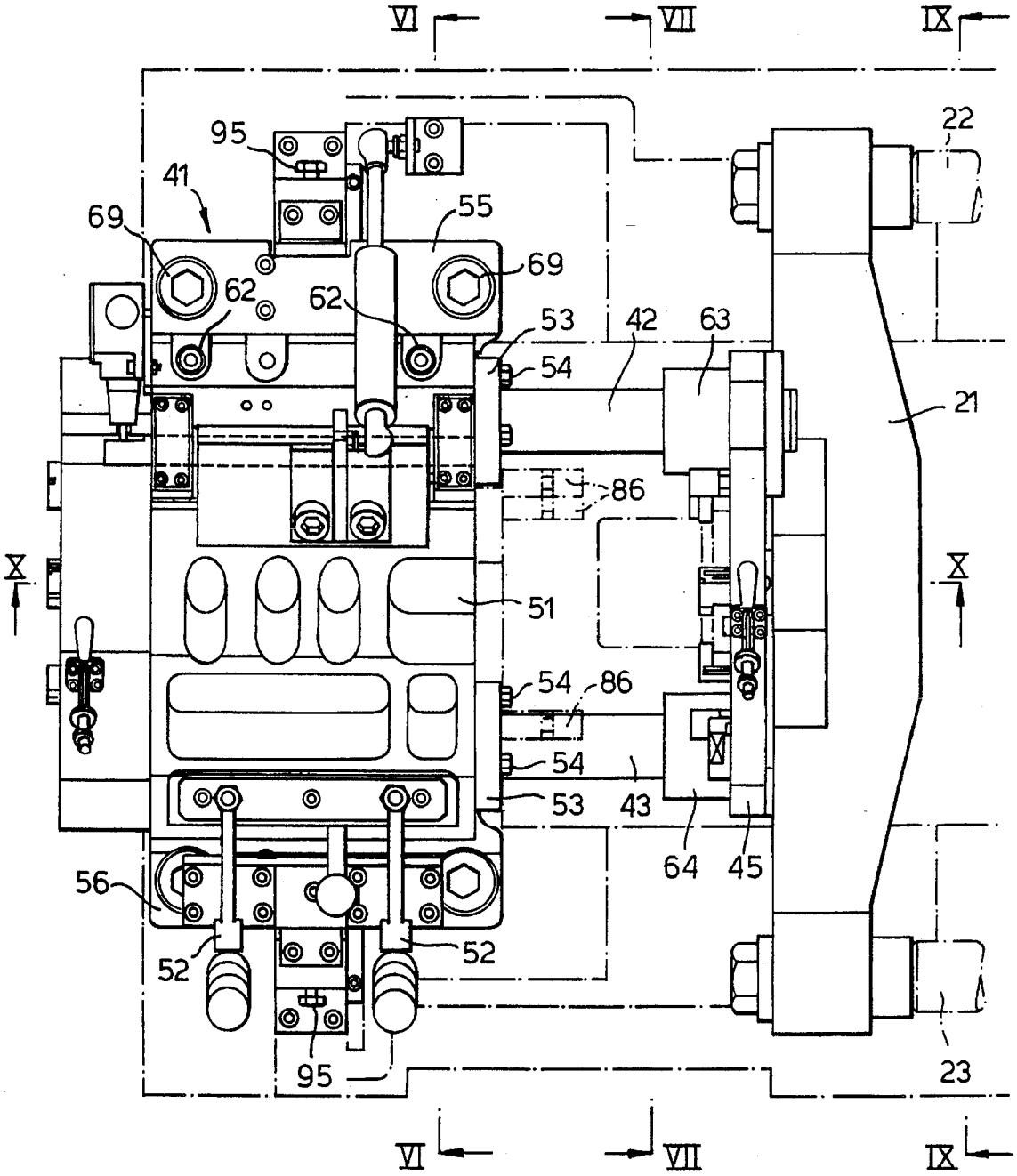
FIG. 5 is a plan view of a crosshead and tool support sketched in FIG. 4.
Figure 6:
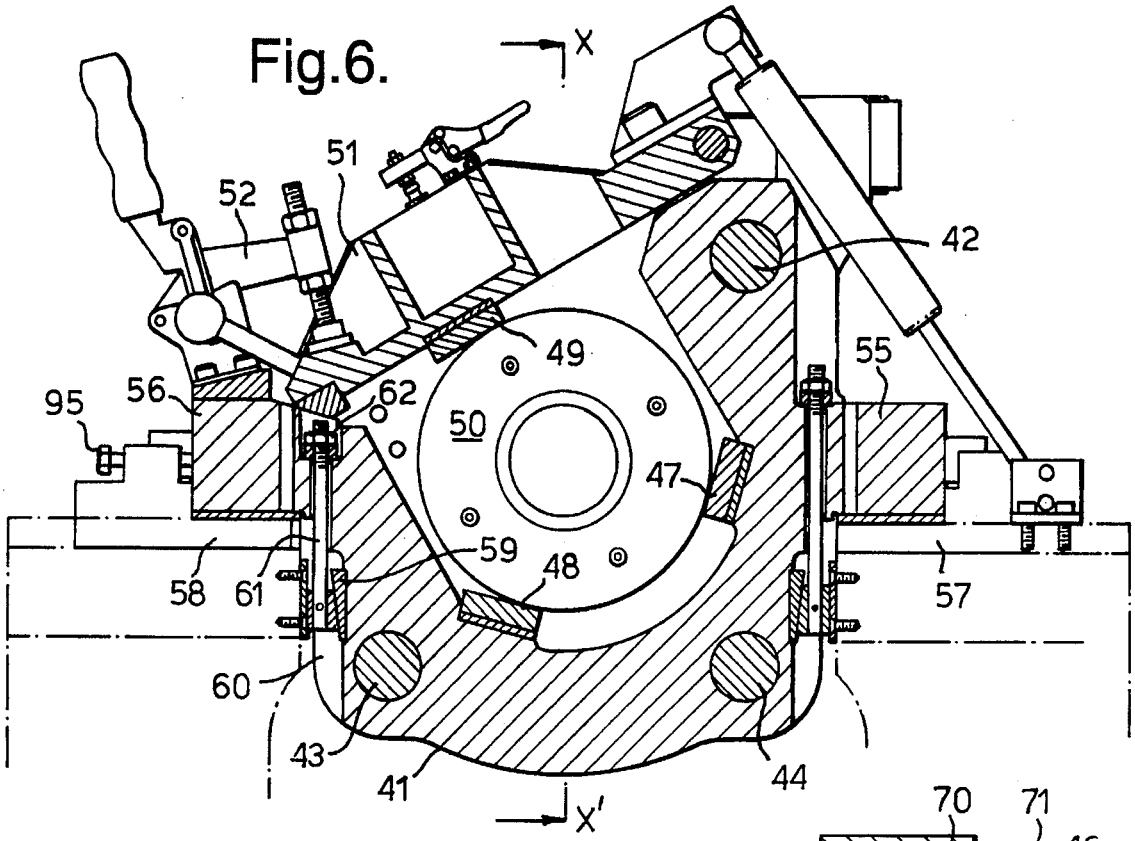
FIG. 6 is a sectioned end view of the tool support taken on line VI—VI in FIG. 5.

FIGS. 5 and 6 show that the cradle surface is closed by a lid 51 which is pivotally attached to the high side of the tool support 41 and held in the closed position by a pair of toggle latches 52. FIG. 6 shows a third support rail 49 extending along the lid to provide a third point of support for each ironing ring 50.

Figure 12:
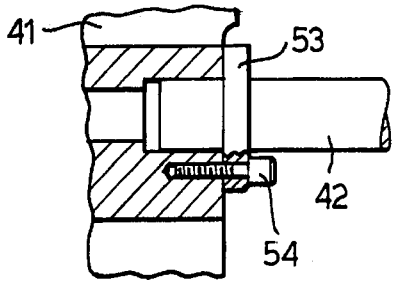
FIG. 12 is a fragmentary section of a pillar rooted in the tool support.

In FIGS. 5 and 12 it will be seen that each pillar 42, 43, 44 has a flange 53 located against the end wall of the tool support 41 nearest the crosshead. The pillar flanges 53 are fixed to the tool support by studs 54.

The tool support has flanges 55, 56 along its length which rests on parallel frame positions 57, 58 (best seen in FIG. 6) with the lower part of the tool support between the frame members 57, 58. There is a clearance between the lower part of the tool support 41 and frame members 57, 58. Fine adjustment of alignment of the tool support 41 with the ram 8 is achieved by placing appropriate shims between the flanges 55, 56 and respective frame members 57, 58 to achieve correct height. Further shims are placed if required between the lower portion of the tool support and frame members 57, 58. Lateral adjustment is facilitated by jack screws, one of which is denoted 95 in FIGS. 5 and 6. When aligned with the axis of the ram 8, the tool support 41 is firmly fixed to the frame members 57, 58 by bolts 69 passing through the flanges 55, 56.

Figure 11:
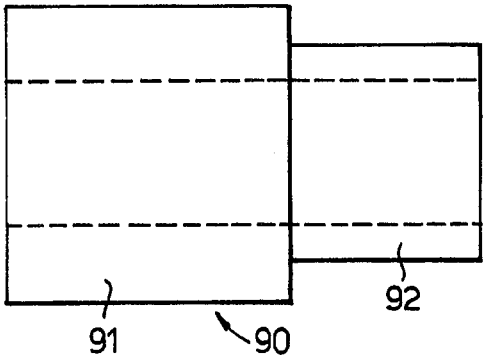
FIG. 11 is a side view of a tool used for setting the blank holder in alignment with the tool support.

The tool support is then wedged in between the frame members by four opposed wedge assemblies, two of which can be seen in FIG. 6, in order to stiffen and strengthen the connection of tool support 41 to the frame. At each side of the lower part of the tool support there is a fixed wedge 59 and a cooperating movable wedge 60 supported by a long rod 61 threaded at the top to take a nut 62 on the top side of each flange 56, 57. Tightening of these nuts 62 raises the movable wedge 60 to cause the tool support 41 to be firmly wedged between the frame members 57, 58 so the whole tool support is accurately aligned with the ram 8. An advantage of setting the whole tool support in accurate alignment with the ram is that ironing rings may be replaced without the trouble of individual setting of each replacement ring. The blank holder is then set on the crosshead in alignment with the tool support. A jig as shown in FIG. 11 may be used.

Figure 7:
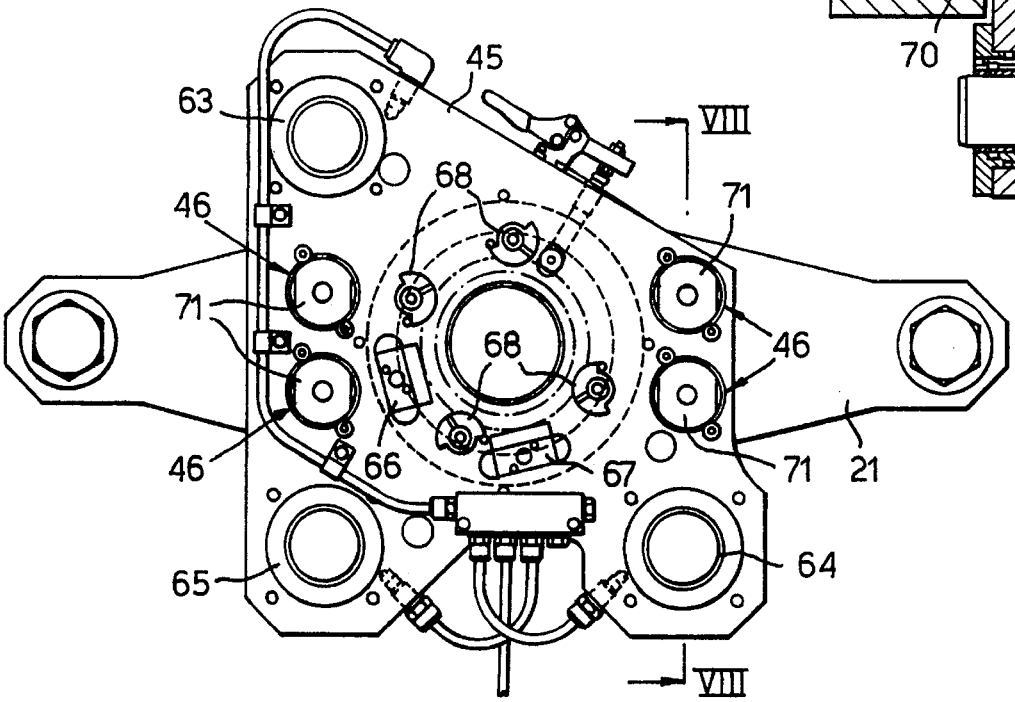
FIG. 7 is a front view of the crosshead and plate taken on line VII—VII in FIG. 5.

The pillars 42, 43 shown in FIG. 5 extend parallel to enter respective sleeve bearings in the plate 45 shown in detail in FIG. 7. The plate 45 is preferably made of light alloy to reduce inertia forces. For example, and aluminium alloy may be used.

FIG. 7 shows that the plate 45 has three sleeve bearings 63, 64, 65 of the kind using prestressed linear bearings which are preferably lubricated by pressurised water based lubricant or air. If an oil is used it must be contained by efficent seals to prevent contamination of cans. There is a hole in the middle of the plate to permit passage of the ram and a punch on the ram, to the tool support. The plate 45 has a pair of blocks 66, 67 to support the flange of a blank holder and four lobed clamps 68 arranged around the hole to hold the flange of the blank holder on the face of the plate.

Figure 8:
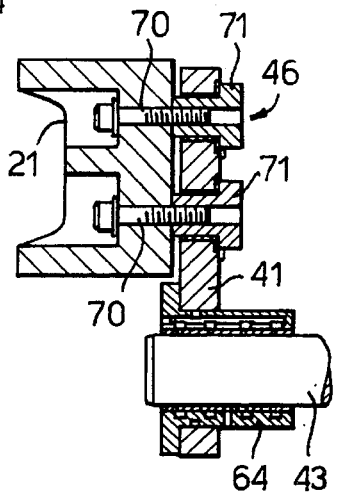
FIG. 8 is a fragmentary section of crosshead and plate fixing, taken on line vIII—vIII in FIG. 7.

The plate is attached to the crosshead by four couplings 46 which permit lateral displacement of the plate relative to the crosshead. In FIG. 8, the couplings comprise bolts 70 having a head on the crosshead side, and a flanged nut 71 on the front side of the plate 45.

Figure 9:
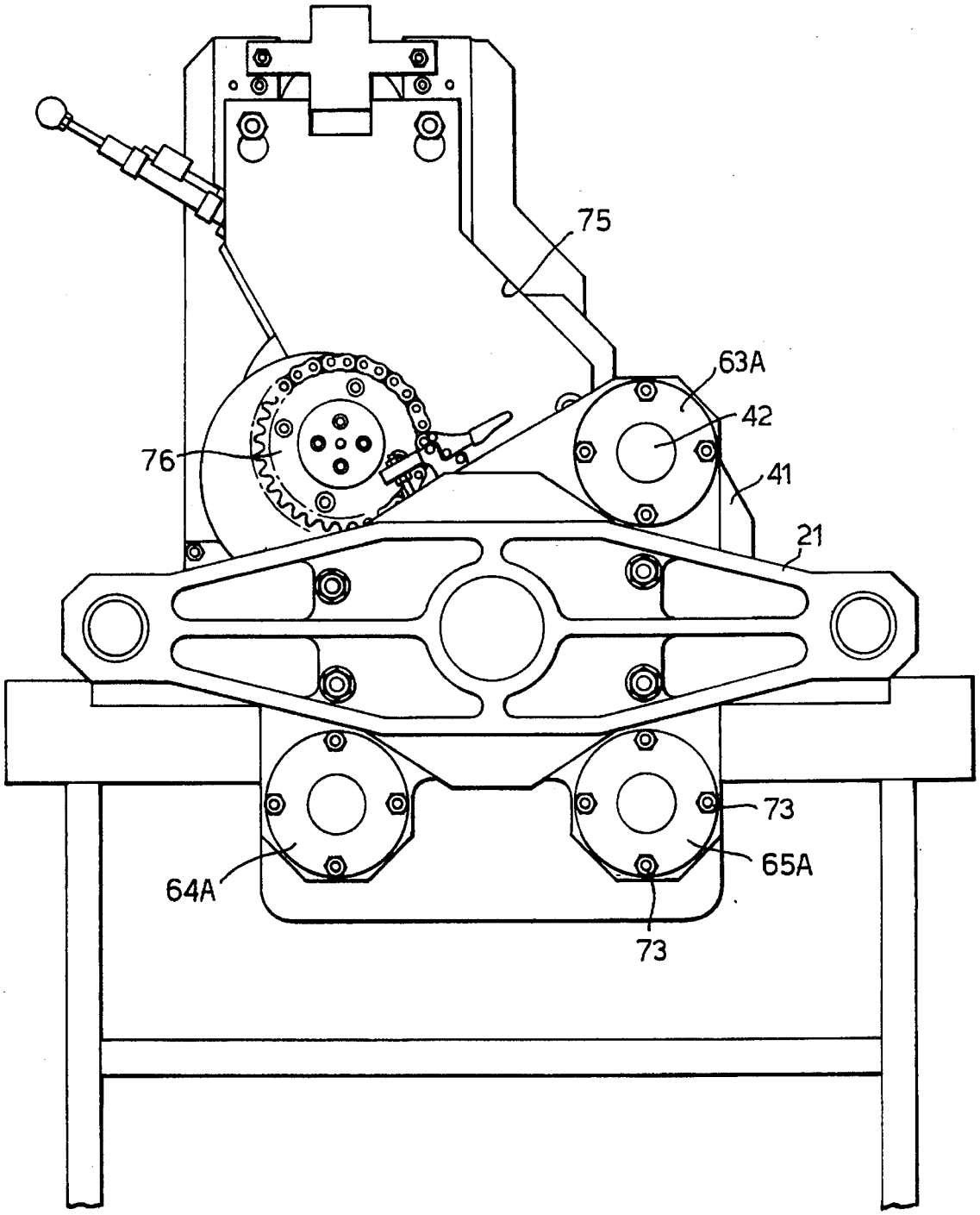
FIG. 9 is a fragmentary view of the crosshead and cupfeeder taken on line IX—IX in FIG. 5.

FIG. 9 shows the back of the crosshead and plate with the three pillars 42, 43 and their respective sleeve bearings 63, 64, 65 clearly visible. Each sleeve bearing has flange 63A, 64A and 65A fixed to the plate by four nuts and bolts generally denoted 73.

FIG. 9 also shows a feed chute 75 and part of a feed mechanism 76 which feeds individual cups in between the blank holder 20 and die.

Figure 10:
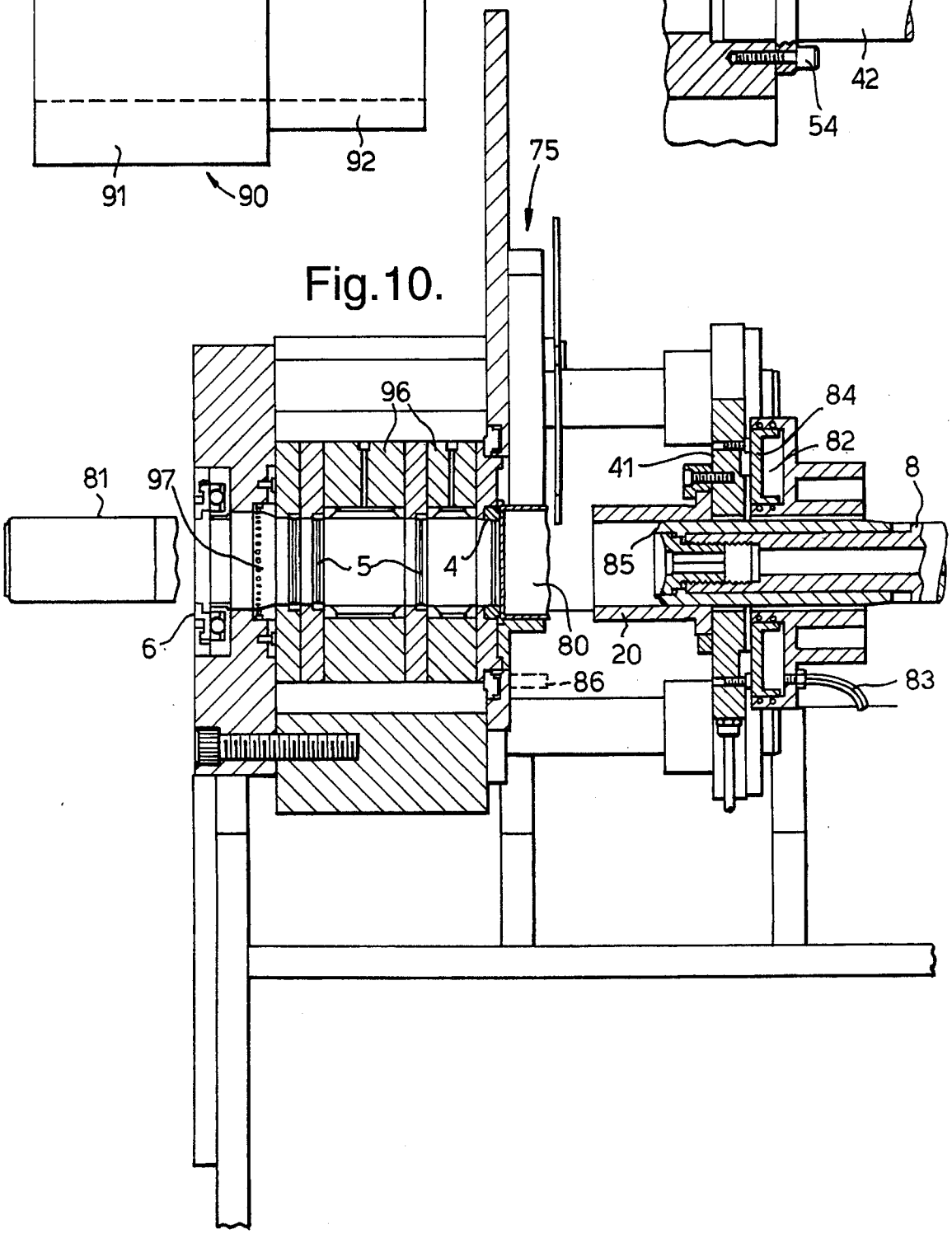
FIG. 10 is a side view of the cross head ram and tool support sectioned on the line X—$X^1$ in FIG. 5.

FIG. 10 shows the feed chute 75 and a cup 80 held in the path of the blank holder 20 and a punch 85 supported on the ram 8 at a time just before the crosshead advances to enter the blank holder into the cup and the punch/ram 8 advances to push the cup through the redrawing die 4 and ironing rings 5 to form the tall can 81 shown at the left of FIG. 10 adjacent the stripper mechanism 6. The dies 5 are held apart by spacers 96 which have passage ways to introduce a lubricant to the dies. Spent lubricant is removed by a coolant removal ring 97 comprising a plurality of apertures into which the lubricant is drawn for recycling.

As shown in FIG. 10, the crosshead 21 has an annular cavity 82 connected to a supply of compressed air 83. In the cavity a piston 84 is movable to urge the plate 41 and blank holder 20 forward against the bottom of the cup 80 on the die face 4 so that prime movement of the blankholder is done by the push rods which are set to a slight over travel and compensated application of a controlled blank holder pressure is done by the air cylinders. Forward motion of the blank holder 20 is limited by stop blocks 86, best seen in FIG. 5, mounted on the end wall of the tool support, which abutt the crosshead plate 41.

When initially locating the blank holder on the crosshead plate 21 its is convenient to use a setting jig 90 shown in FIG. 11. The jig has a first cross section 91 to match the circular wall ironing dies 5 and a hollow second section 92 to surround the blank holder. Resting of the first cross section on the cradle rails, and nesting of the blank holder in the hollow section ensures accurate alignment of blank holder 20 and cradle rails 47, 48.

Hitherto, it has been customary to have clearance between the internal cylindrical surface of the blank holder and the external surface of the punch. It is customary to provide the punch with a portion of reduced diameter distant from the free end of the punch so that the wall ironed can has a thicker side wall margin at the mouth. If, contrary to prior practice the internal surface of the blank holder is made a sliding fit in the punch, the punch receives support right up to the time it enters the redrawing die. The internal surface of the blank holder may be provided with an annular cavity (not shown in FIG. 10) into which a pressurised lubricant is fed to lubricate travel of the punch in the blank holder.

Although a preferred embodiment of the invention has been specifically illustrated and described herein, it is to be understood that minor variations may be made in the apparatus without departing from the spirit and scope of the invention, as defined the appended claims.

We claim:

1. A subpress for use in a press comprising a first action to drive a ram (8) supporting a punch and a second action to drive a pair of drive rods (22, 23) joined by a crosshead (21) to a blankholder (20) cooperative with tools in a tool support (41), said tool support (41) having a first side wall portion, a second side wall portion parallel to the first side wall portion, and a base joining the side wall portions to enclose a tool support surface extending from a first end surface to a second end surface of the wall portions; at least two pillars (42, 43) extending away from and slidable relative to said first end surface of the side wall portions in a direction parallel to an axis of the tool support surface;

a crosshead plate (45), means for securing the pillars (42, 43) to the crossheadplate (45) for guided motion towards and away from the tool support (41), said crosshead plate (45) having a hole through it centred on the axis of the tool support surface to permit passage of the punch to the tool support by said first action, and means for connecting the crosshead plate (45) to the crosshead (21) driven by the second action.

2. A subpress assembly according to claim 1 having a hollow blankholder, fixed in axial alignment with the axis of the tool support surface, on a face of the crosshead plate facing the first end wall surface of the tool support.

3. A subpress assembly according to claim 1 wherein the tool support surface includes a pair of parallel rails fixed to an interior surface of the wall portions of the tool support.

4. A subpress assembly according to claim 1 wherein the pillars are rooted in the first end wall of the tool support and the crosshead plate has linear bearings which surround the pillars.

5. A subpress assembly according to claim 1 wherein the crosshead plate has couplings which permit lateral displacement relative to the second action of a press.

6. A subpress assembly according to claim 1 wherein the first side wall of the tool support is higher than the second side wall and side walls and base define a "U" shaped channel inclined to the base.

7. A subpress assembly according to claim 1 wherein the tool support has opposed flanges extending from the side walls to permit alignment and fixing to a press frame.

8. A subpress assembly according to claim 2 wherein the blank holder has a flange centred by a three point array of two blocks and a retaining screw.

9. A subpress assembly according to claim 3 having a lid, spanning the side walls of the tool support, which supports a third rail to complete a three-point support for tools in the tool support.

10. A subpress assembly according to claim 7 wherein opposed flanges rest on press frame member's with a lower portion of the tool support between them and opposed wedges between the lower portion and the frame members rigidly hold the tool support in the frame members.

* * * * *